United States Patent [19]

Funk et al.

[11] 3,947,015

[45] Mar. 30, 1976

[54] PAPER SHEET FEEDERS HAVING MULTIPLE STORAGE MAGAZINES

[75] Inventors: Rudolph Funk, Jamison; Roger S. Funk, Holicong, both of Pa.

[73] Assignee: R. Funk & Co., Inc., Doylestown, Pa.

[22] Filed: Oct. 19, 1973

[21] Appl. No.: 407,967

Related U.S. Application Data

[63] Continuation of Ser. No. 151,723, June 10, 1971, abandoned.

[52] U.S. Cl. ..... 271/9; 271/117

[51] Int. Cl.[2] ..... B65H 1/28; B65H 3/06

[58] Field of Search ..... 271/9, 117, 118; 270/58; 221/130, 124

[56] References Cited

UNITED STATES PATENTS

| | | | |
|---|---|---|---|
| 1,443,698 | 1/1923 | Avery | 271/9 X |
| 2,679,801 | 6/1954 | Ford et al. | 271/117 X |
| 3,110,490 | 11/1963 | Limberger | 271/117 X |
| 3,208,746 | 9/1965 | Mestre | 271/117 |
| 3,323,790 | 6/1967 | Pankow | 271/9 X |

FOREIGN PATENTS OR APPLICATIONS

| | | | |
|---|---|---|---|
| 1,160,164 | 7/1969 | United Kingdom | 271/9 |

*Primary Examiner*—Evon C. Blunk
*Assistant Examiner*—Bruce H. Stoner, Jr.
*Attorney, Agent, or Firm*—Synnestvedt & Lechner

[57] ABSTRACT

A cut-sheet feeder, for delivering various sizes of sensitized paper sheets to the feed table of a printing machine, has nested adjustable magazines for storing quantities of sheets of several predetermined sizes, and the magazines extend at an angle beneath the table and have curved discharge throats for projecting sheets, one at a time, above and onto the table; said throats serving also as light-shields or hoods. Layers of frictional material are positioned to hinder the discharge of sheets from the magazines, excepting for the foremost sheet of each stack, which is normally in contact with a feed roller, urged against it by a spring, and the feed rollers are individually driven, each by a separate motor, and coordinated by an electrical control system; the feed-roll drive including an overrunning clutch so that the operator can pull a sheet out, if desired, beyond the point to which it may be fed by the feed-roll when actuated by the timer-controlled motor. The apparatus also incorporates such features as: pivoting of the discharge throats for ready loading of the magazines; adjustability of the magazines, not only to receive sheets of various sizes, but also to provide for proper storage and feed of oblong sheets with either of two differing edges foremost; and means for adjusting the sheet feeder to adapt it to different printers.

1 Claim, 15 Drawing Figures

INVENTORS
RUDOLPH FUNK
ROGER S. FUNK
BY
Synnestvedt & Lechner
ATTORNEYS

INVENTORS
RUDOLPH FUNK
ROGER S. FUNK
BY
Symmestvedt + Lechner
ATTORNEYS

INVENTORS
RUDOLPH FUNK
ROGER S. FUNK
BY
Symmetvedt + Lechner
ATTORNEYS

INVENTORS
RUDOLPH FUNK
ROGER S. FUNK

BY

Symmestvedt & Lechner
ATTORNEYS

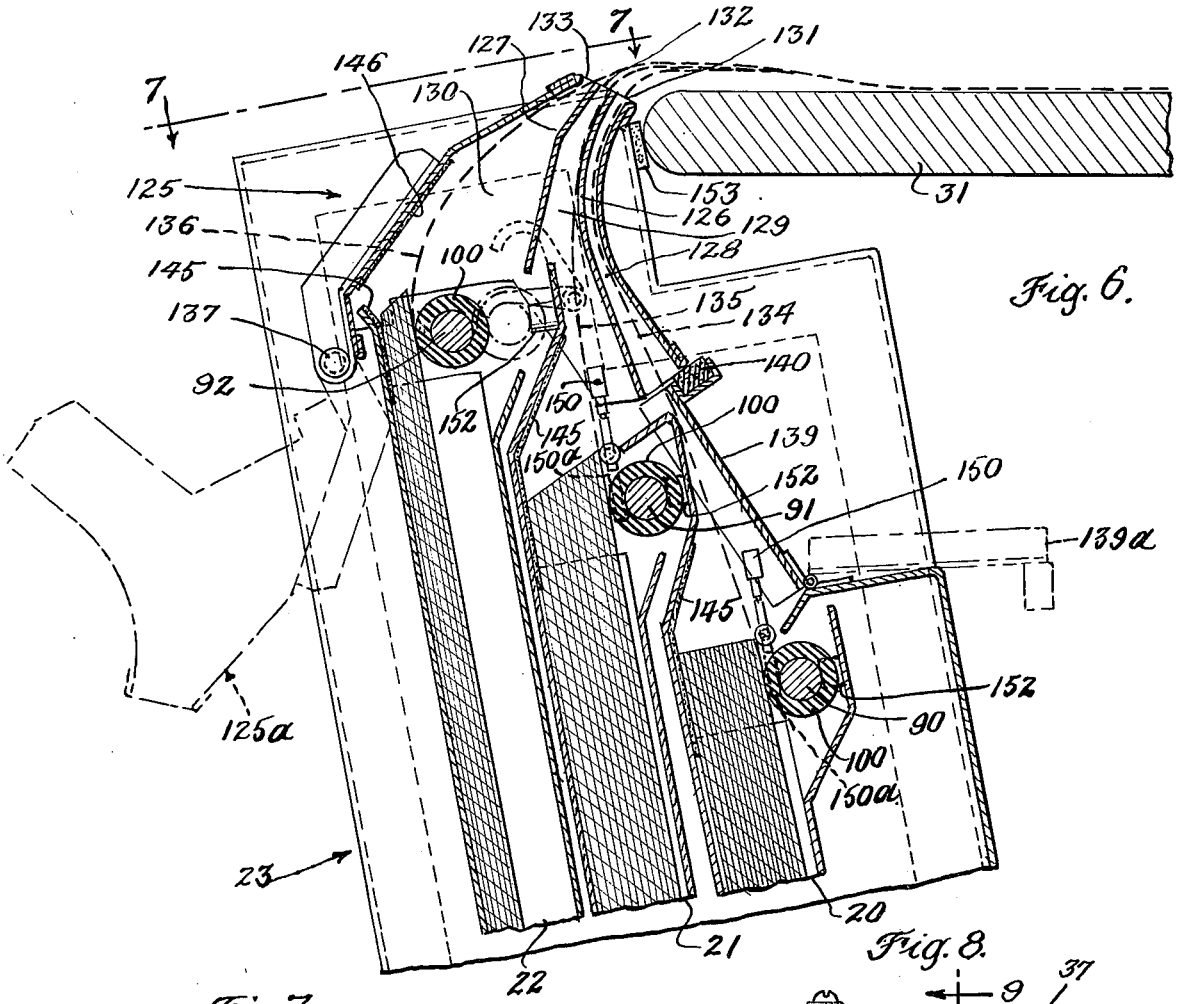
Fig. 6.
Fig. 7.
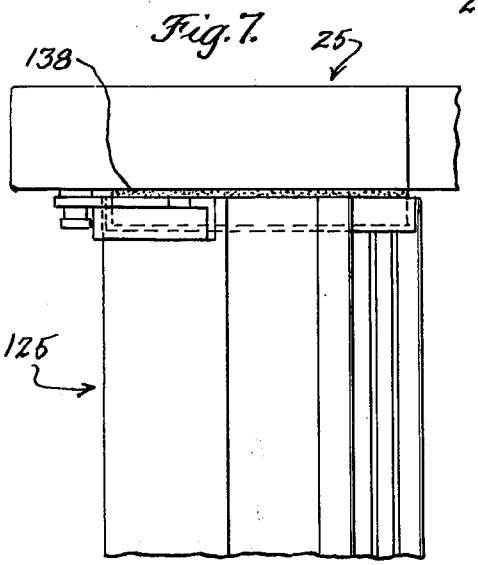
Fig. 8.
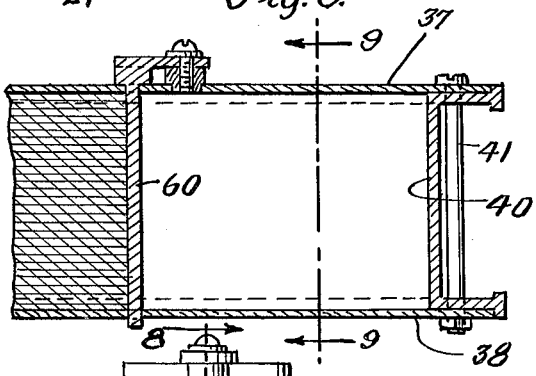
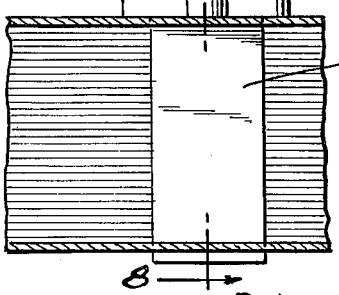
Fig. 9.
Fig. 10.
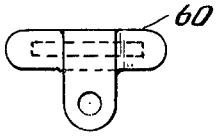
INVENTORS
RUDOLPH FUNK
ROGER S. FUNK
BY
Symmestvedt & Lechner
ATTORNEYS INVENTORS
RUDOLPH FUNK
ROGER S. FUNK
BY
Symmestvedt + Lechner
ATTORNEYS

PAPER SHEET FEEDERS HAVING MULTIPLE STORAGE MAGAZINES

The present application is a continuation of our application Ser. No. 151,723, filed June 10, 1971, and abandoned as of the filing date of the present application.

This invention relates to sheet feeding apparatus, and especially to portable apparatus adapted to feed individual paper sheets of predetermined dimensions from a stored supply to a zone of operations, such as an associated printing machine, the said paper sheets being, typically, sensitized sheets for delivery to the feed board of the printing machine.

More specifically, the invention relates to apparatus for storing cut sheets of print paper of predetermined dimensions in storage pockets or magazines and for feeding sheets selectively, one at a time, from the storage pockets or magazines to the feed board of a diazo printer.

The principal object of the invention is to provide simple, compact apparatus adapted to increase productivity in the matching up of engineering tracings to diazo or sensitized print paper sheets of various sizes by simple selection and feed of a sheet of particular size to the feed board of a printer.

Another object of the invention is the provision of cut sheet feeding apparatus adapted for ease of loading of the storage pockets.

A further object of the invention resides in the provision of apparatus adapted to permit the feeding of both the print paper and engineering tracing into the printer in an effective manner.

Another object of the invention resides in the compact nesting and disposition of the storage pockets or magazines.

Other objects of the invention have to do with the provision of effective light seals, simple construction of the storage pockets, simple drive means, and means preventing double feed of sheets out of the storage pockets.

How the foregoing and other objects and advantages of the invention are attained will be clear from the following description and drawings which illustrate a preferred form of apparatus embodying the invention, in which drawings.

Figures 3A, 4:
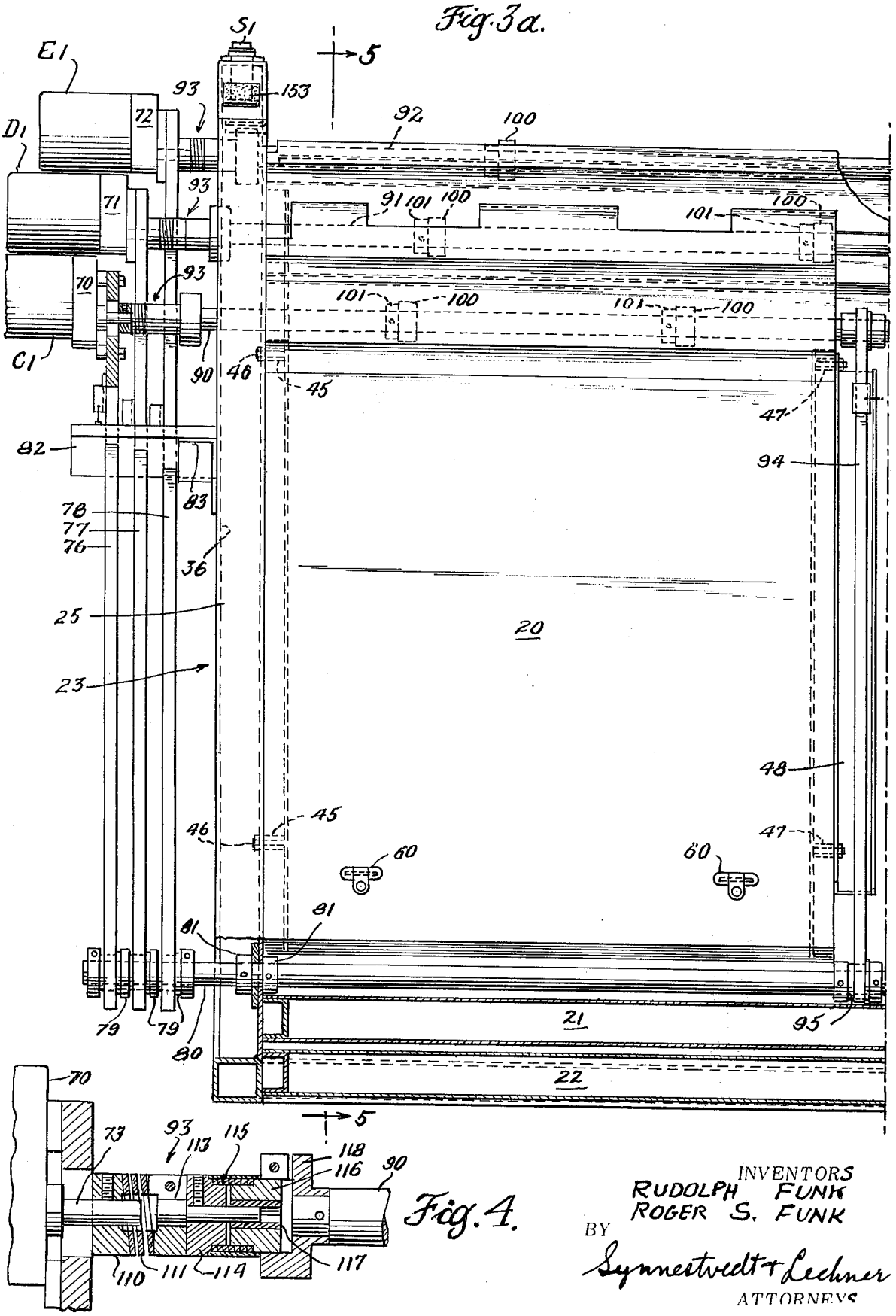
Figure 3B:
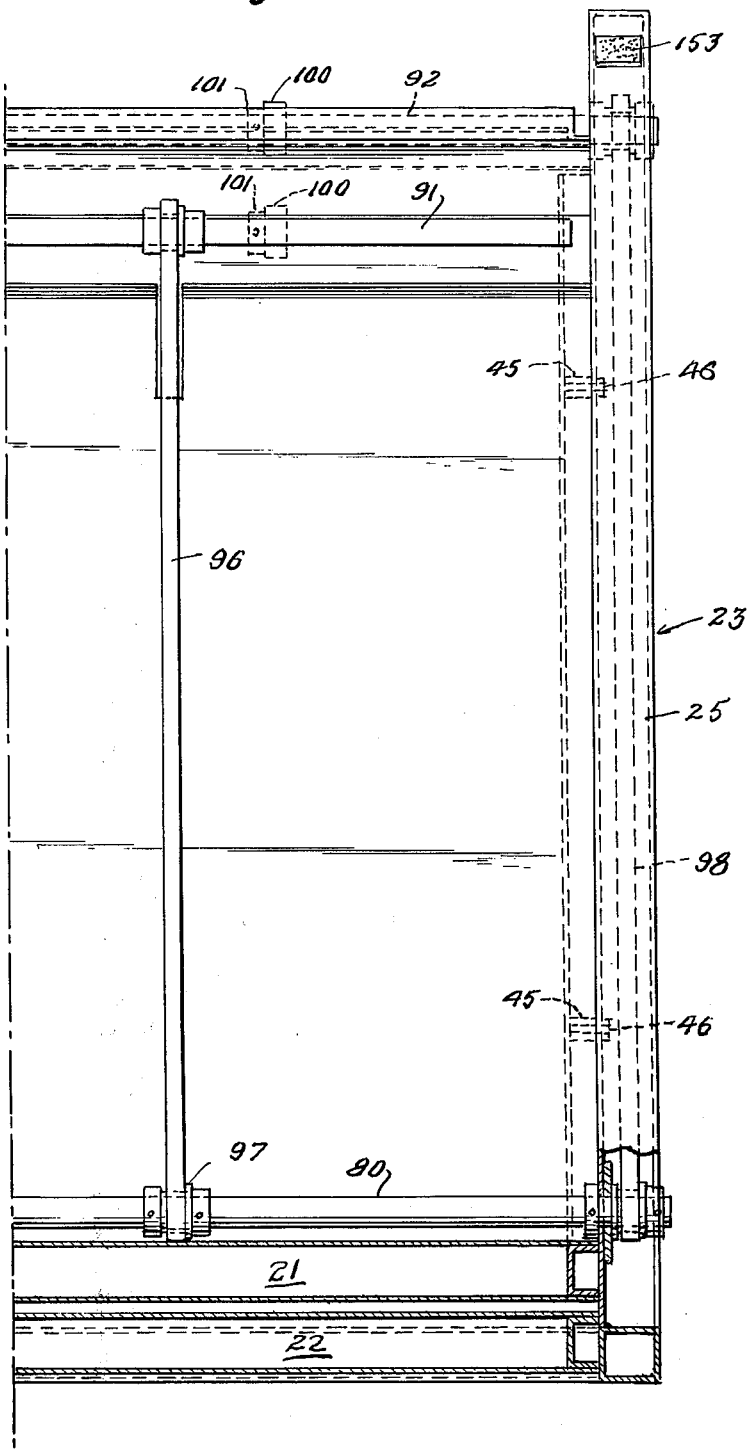
Figure 5:
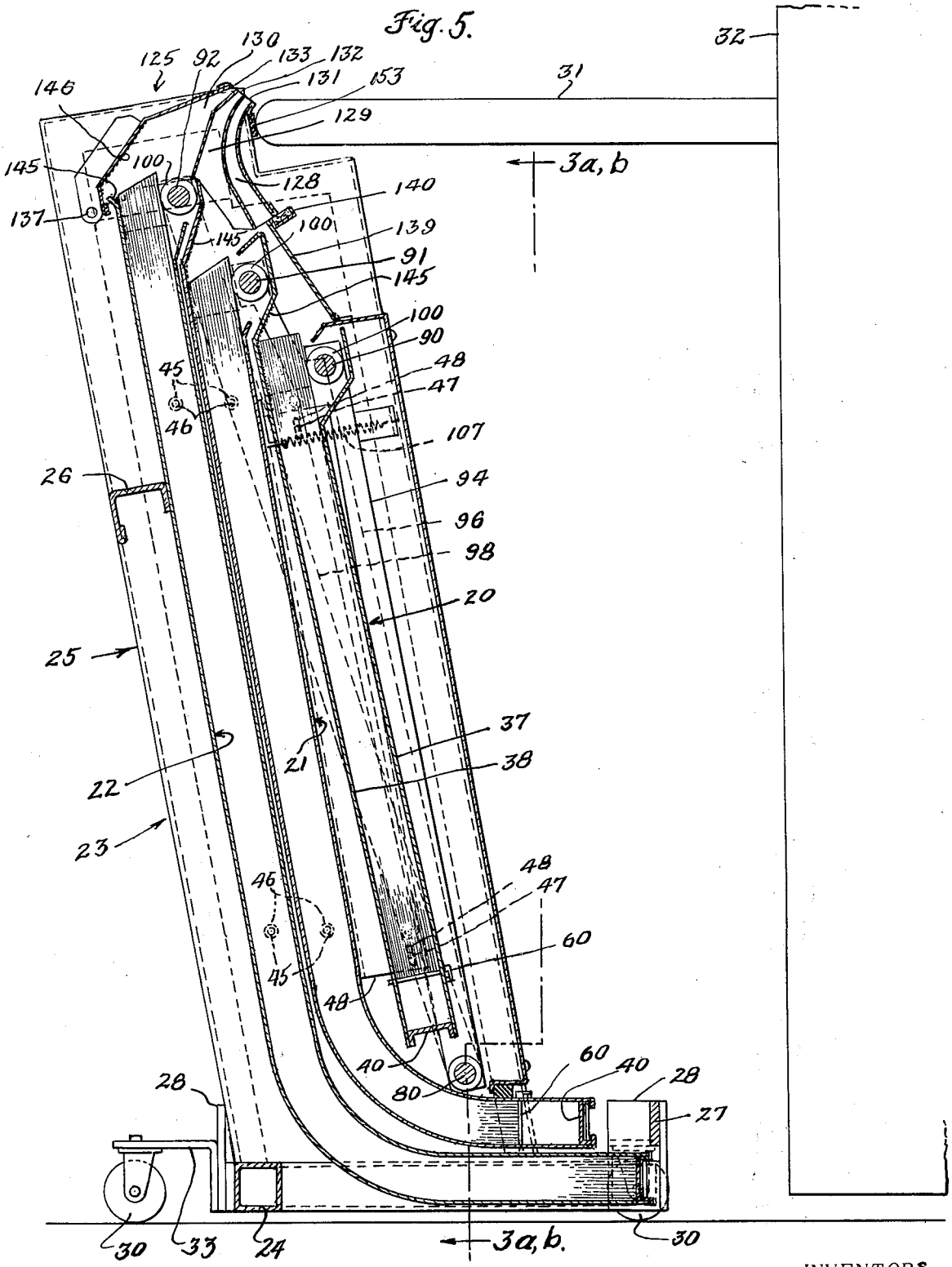

FIGS. 3*a* and 3*b* taken together illustrate a widthwise sectional elevational view of the apparatus taken as indicated by the line 3*a*, *b* – 3*a*, *b* in FIG. 5, with the upper sheet discharge hood omitted;

FIG. 4 is a detail longitudinal section of a combined flexible coupling and clutch device employed at the drive end of the three sheet feed roll shafts of the apparatus;

FIG. 5 is a vertical sectional view taken on the line 5—5 of FIG. 3*a;*

Figure 11:
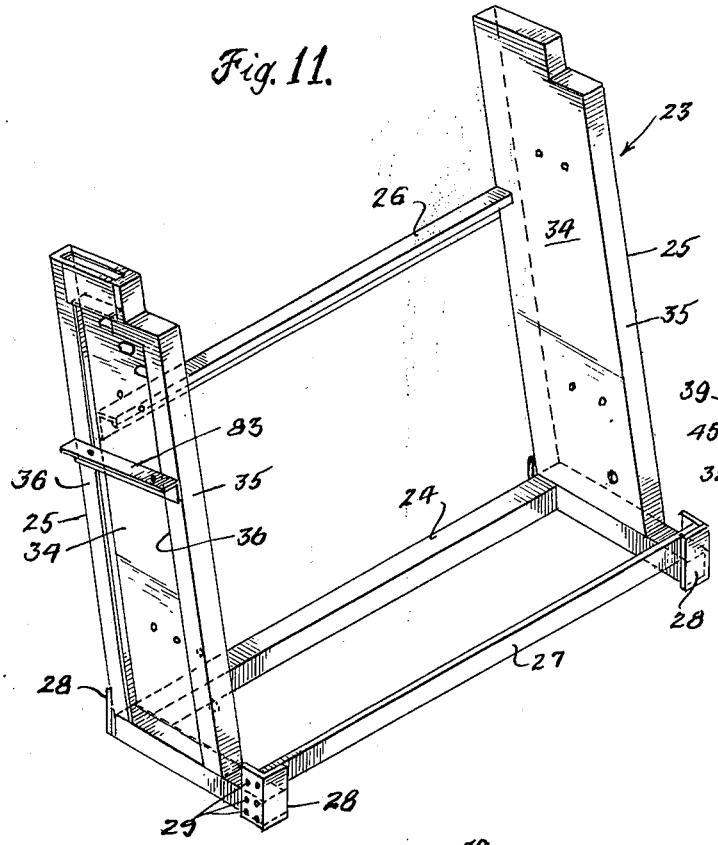
Figure 12:
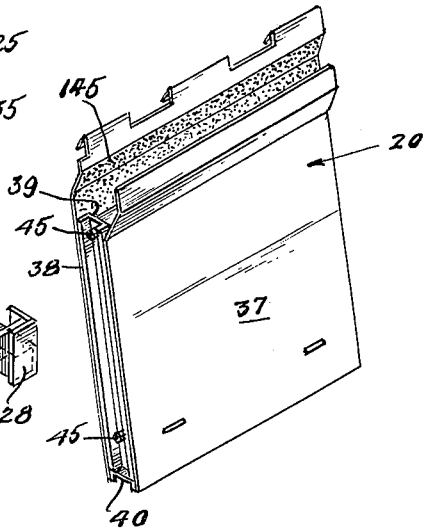
Figure 14:
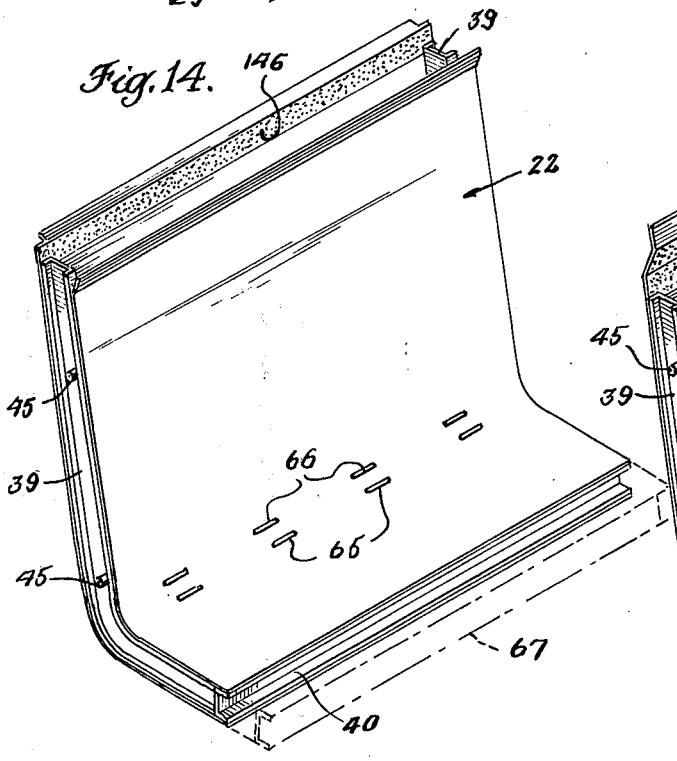
Figure 13:
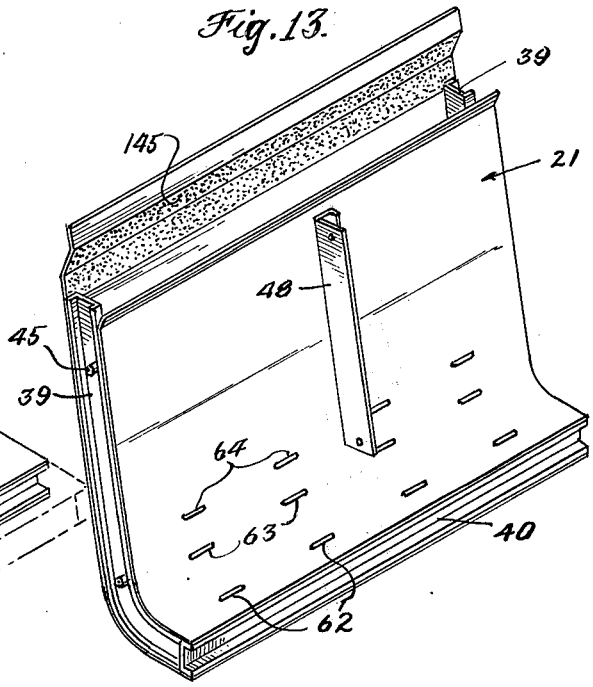

FIG. 6 is a somewhat enlarged fragmentary sectional view illustrating the upper portions of the sheet storage pockets or magazines and the associated sheet dispensing hood and access lid in detail, the hood and lid being indicated in their open positions in dot and dash lines;

FIG. 7 is a fragmentary plan view, taken as indicated by the arrows 7—7 in FIG. 6, illustrating an end light restrictive seal between the hood and the end frame of the device;

FIG. 8 is an enlarged detailed sectional view of the lower end of one of the sheet storage pockets seen in FIG. 5, taken on the line 8—8 of FIG. 9, illustrating a readily applicable stop employed in the sheet storage pockets to accommodate the pockets to sheets of various sizes;

FIG. 9 is a cross section taken on the line 9—9 of FIG. 8;

FIG. 10 is a detail plan view of one of the sheet stops;

FIG. 11 is an isometric view of the main frame of the apparatus;

FIG. 12 is an isometric view of the sheet pocket hereinafter referred to as the C pocket;

FIG. 13 is an isometric view of the sheet pocket hereinafter referred to as the D pocket; and FIG. 14 is an isometric view of the sheet pocket hereinafter referred to as the E pocket.

Before describing the apparatus in detail the general arrangement of the main components of the apparatus will be described and various parts will be designated by the terms used hereinafter in the specification.

By way of example, but not limitation, the apparatus will be described for storing and feeding cut sensitized sheets of print paper 17 in. × 22 in. or 18 in. ×24 in. dimensions hereinafter referred to as of C size; sheets of 22 in. × 34 in. × 24 in. × 36 in. dimensions hereinafter referred to as of D size; and sheets of 34 in. × 44 in. or 36 in. × 44 in. dimensions hereinafter referred to as of E size. In this particular instance, as seen in FIG. 5, three storage pockets are employed, the right hand pocket 20 being for sheets of C size, the middle pocket 21 being for sheets of D size and the left hand pocket 22 being for sheets of E size. By way of example, the pockets each typically has a capacity of 250 sheets of 20 lb. paper.

The apparatus is provided with a main frame 23 comprising a bottom frame member 24 of U-shape in plan view (FIG. 11), upright end members or legs 25, 25, a rear connecting brace 26 and a bottom cross brace 27. At the four corners of the bottom frame member 24 caster supports 28 are secured in place. These are provided with a plurality of spaced holes 29 for up and down height adjustment of the casters 30 (see FIG. 1) to suit the height of the feed board 31 of the diazo printer 32. By referring to FIG. 1 it will be seen that with the caster angle braclets 33 in the position shown, certain height adjustment may be made by means of the holes 29 and that further height adjustment may be made by reversing the angle brackets 33.

Figures 1, 2:
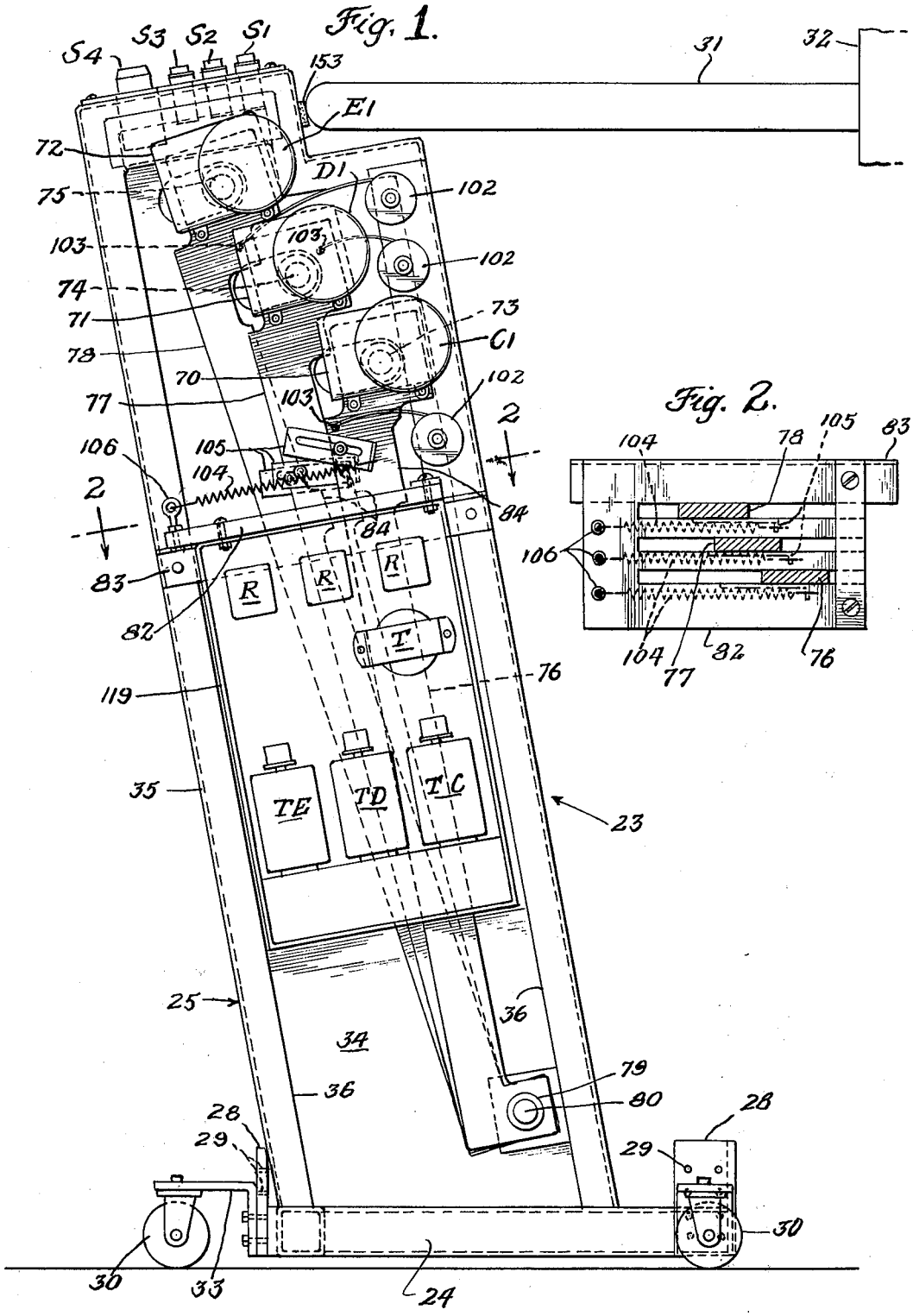
FIG. 1 is an end elevational view of a sheet feeder constructed in accordance with the invention.
FIG. 2 is a plan section taken on the line 2—2 of FIG. 1 illustrating a slotted guide plate employed to guide a plurality of sheet feed roll pivot arms against twisting movement, in this instance three such pivot arms being employed.

The upright end members 25, 25, of the frame slant downwardly, so as to extend under the printer feed board 31 (FIGS. 1 and 5). They comprise web portions 34 and edge flanges 35 having inturned portions 36 (FIG. 11). These end members are welded to the bottom frame member 24. It will thus be seen that although the frame is of simple construction it nevertheless is very rigid.

Reverting now to the storage pockets 20, 21 and 22, these are of like very simple and light construction and description of the pocket of FIG. 12 will suffice for an understanding of the construction of the other pockets. It comprises front and back plates 37 and 38 of light material spaced apart by simple end channel members 39 and lower end closure channel member 40. These lower closure members 40 are detachably secured in place by bolts 41 as seen in FIG. 8. The pockets are open at the top but otherwise they are closed so as to be light restrictive when in place.

As seen in FIG. 3*a* the C-size pocket 20 extends in width from the frame leg 25 at the left to a point intermediate of the left and right legs 25, 25, while the D and E-size pockets 21 and 22 extend from the left leg 25 to the right leg 25. (see FIG. 3*b*). The fact that the pocket 20 is narrower than the pockets 21 and 22 is clear also from comparison of FIGS. 12, 13 and 14. It will also be observed from these figures that the end channel members 39 of the pockets 20, 21 and 22 are provided with vertically spaced studs 45, having threaded holes to receive bolts for securing the pockets in place.

The D-size pocket 21 and the E-size pocket 22 are secured to the webs 34 of the legs 25 by means of bolts 46 passing through holes in the webs and screwing into the threaded holes of the studs 45 just mentioned (FIGS. 3*a*, 3*b* and 5). The C-size pocket 20, however, since it is narrower than the pockets 21 and 22, is secured at its left hand end to the web of the left hand leg 25 and at its right hand end by means of bolts 47 to an upright angle iron 48 carried by the D-size pocket 21. A limited amount of vertical adjustment as between the pockets 20 and 21 is provided by slots 49 (FIG. 5).

Before describing the feed mechanism for the discharge of the sheets from the pockets the various ways that sheets can be placed in the pockets will be described. Referring first to the pocket 20 for the C-size sheets which as above mentioned is for receiving C-size sheets of 17 in. × 22 in. or 18 in. × 24 in. dimensions. Assuming now that 17 in. × 22 in. sheets are to be loaded, then a readily applicable stop 60 shown in detail in FIGS. 8, 9 and 10 is inserted in slots 61 provided toward the bottom of pocket 20 (FIG. 12) and the sheets are inserted short side down, i.e., with the 17 in. dimension down. When 18 in. × 24 in. sheets are to be loaded, the stops 60 are removed and the sheets are inserted short side first, i.e., with the 18 in. dimension down, to rest on the lower end 40 of the pocket.

Referring now to the second or middle pocket 21 for the D-size sheets which as above mentioned is for receiving D-size sheets of 22 in. × 34 in. or 24 in. × 36 in. dimensions, it is pointed out that when 22 in. × 34 in. sheets are to be loaded stops 60 are inserted in slots 62 (FIG. 13) and the sheets are inserted either short or long side first to rest against the stops 60. When 24 in. × 36 in. sheets are to be loaded, the stops 60 are removed and the sheets are inserted short side first to rest against the lower end 40 of the pocket. As seen in FIG. 13, other slots 63, and 64 are provided in the pocket 21 for receiving stops 60 if sheets are to be inserted in the pocket long side first.

Referring now to the third or left hand pocket 22 which as above mentioned is for receiving E-size sheets of 34 in. × 44 in. or 36 in. × 44 in. dimensions, the sheets are inserted, short side first, no stop is used, and the sheets rest against the fixed end 40 of the pocket. It is here mentioned that in the event that a user does not desire to process E-size prints, he may use the E-pocket for storing D-size sheets by inserting stops in suitably located slots 65 in the pocket 22. Thus the user is enabled to readily double up on storage of D-size sheets. It is pointed out that other stop slots 66 are provided in the pockets for storing sheets of odd size, if desired.

It is further pointed out that if a user should want to handle sheets of greater length than the E-pocket will accommodate, a longer pocket may readily be substituted for the standard E-pocket as indicated in dot and dash lines at 67 in FIG. 14.

Referring now to the sheet feed mechanism of the apparatus, as shown in FIG. 3*a;* this comprises in general three drive motors C1, D1 and E1 and associated gear reduction units of known form indicated at 70, 71 and 72, having power take-off shafts 73, 74 and 75. (see FIGS. 1 and 4).

The drive motor C1 with its gear unit 70 is secured to the upper end portion of a pivoted upright arm 76, the drive motor D1 with its gear unit 71 is secured to the upper end portion of a pivoted upright arm 77, and the drive motor E1 with its gear unit 72 is secured to the upper end portion of a pivoted upright arm 78.

As clearly seen in FIGS. 1 and 3a and the three pivoted arms 76, 77 and 78 are grouped closely together and are pivotally mounted by means of bearings 79 on a common non-rotating laterally extending shaft 80 supported adjacent its ends in the webs 34 of the frame members 25, 25. The shaft 80 is laterally positioned by snug fitting collars 81, 81.

As seen in FIGS. 1, 2 and 3*a*, the pivot arms 76, 77 and 78 are of relatively thin form and are guided, toward their upper ends, against twisting, by a slotted guide plate 82 (FIG. 2) secured to the inturned flanges 36 of the end frame legs 25 by an angle iron 83, it being noted that the widths of the pivot arms are increased somewhat at 84 in the region of the guide plate 82 to better insure against twisting.

The provision of arms of relatively thin material, their compact grouping and guidance against twist, and their mounting by relatively simple bearings 79 on the common shaft 80, result in desirable compactness of design.

The power take-off shafts 73, 74 and 75 are respectively connected to the sheet feed shafts 90, 91 and 92 of the three pockets 20, 21 and 22 by means of combined flexible couplings and clutch units 93. The unit 93 for the pocket 20 is illustrated in detail in FIG. 4 and will be fully described later.

As seen in FIG. 3*a*, the sheet feed shaft 90 of the pocket 20 is rotatably mounted at its right hand end in the upper end of a pivoted arm 94 located adjacent the right hand end of the pocket 20 and pivotally mounted on the common shaft 80 by a bearing 95. It is noted that the shaft 90 ends at the pivoted arm 94 but that the common shaft 80 continues on to the right hand end of the apparatus.

The sheet feed shaft 91 of the pocket 21 is rotatably mounted at its right hand end in the upper end of a pivoted arm 96 located as shown in FIG. 3b which is pivotally mounted on the common shaft 80 by a bearing 97.

The sheet feed shaft 92 of the pocket 22 is rotatably mounted at its right hand end in the upper end of an outboard pivoted arm 98, which is pivotally mounted on the common shaft 80 by a bearing 99.

Each of the sheet feed shafts 90, 91 and 92 has secured thereon, in suitably spaced lateral relationship, sheet feed rollers 100, preferably of rubber, which are held in feeding contact with the sheets of the pockets in a manner further appearing. These rollers can be adjusted laterally by means of collars 101 secured to their shaft by suitable set screws.

As seen in FIG. 1, each of the three pivot arms 76, 77 and 78 has a counterbalancing strap spring device (also known as a Negator) 102 connected thereto at 103, which act to bias the levers and motors toward the right. Also as seen in FIGS. 1 and 2, each arm also has a spring 104 connected at one end to a clip 105 adjustably carried by the arm and at its other end to an eyelet 106 of the fixed guide plate 82. These springs are adjusted to a strength such as to maintain the feed rollers in contact with the sheets with sufficient pressure to effectively cause feed of sheets out of the pockets. At the opposite, or right end, similar springs 107 (FIG. 5) are provided for the pivoted arms 94, 96 and 98 at that end. No Negators are employed at this end.

Reverting now to the combined flexible coupling and clutch units 93 for the three pockets, since all three are of like construction, only the unit for the pocket 20, illustrated in detail in FIG. 4, will be described. The coupling comprises a collar 110, secured on the output shaft 73 of the gear unit 70 of motor C1, and connected by a spiral spring 111 to a second collar 112 secured on a shaft 113 of the clutch in known manner. The clutch, known in the art as a "Marquette Clutch", includes the shaft 113 which has a collar 114 secured thereon which in turn is connected by a torsion spring 115 to a coaxial sleeve 116 having an antifriction bearing 117 on the shaft 113. The sleeve 116 is connected by a split collar 118 to the sheet feed shaft 90.

The flexible coupling allows for any slight misalignment of the output shaft 73 and the sheet feed shaft 90. Also if, for example, one should take hold of the right hand end of the feed shaft 90 and shift it, the flexible coupling would yield and thus prevent undue strain on the output shaft 73. Also the tension of the pivot arm springs at the left hand end might differ somewhat from the tension of the pivot arm springs at the right hand end thus causing the feed roll shaft to be slightly out of alignment with the gear box shaft, and in such event this novel arrangement of combined coupling and clutch unit provides what may be termed a floating connection between the shafts.

The Marquette Clutches, as is well known, are free wheeling clutches and serve a very unique and important purpose in the present invention, as will further appear.

As seen in FIGS. 1 and 3*a*, the apparatus includes three push button switches S1, S2 and S3, one for each pocket, and an on and off switch S4 conveniently located at the top of the end frame member. It will be clear from the foregoing that the provision of separate, adjustable, timers for controlling the motors which actuate the feed rolls for the several magazines makes it possible to adjustably control the distance that the loading edge of the various-sized sheets is thrust onto the feed table 31, which greatly facilitates the work of the operator who must register the sheets with the reproducibles as they are delivered into the printer. This is an important factor in the productivity of the operator and of the installation as a whole. Timers TC, TD, and TE are connected into the circuit of the switches, which timers are adjustably set to time out and stop motor feed of the sheets after a desired amount of sheet has been fed onto the feed board of the printer. In some instances the whole sheet is fed onto the feed board, but in other instances it is desirable to stop feed of the sheet when it is part way on the feed board so that the operator can pull the sheet out to match it with the engineering tracing. When this is done the Marquette Clutch will free wheel. Without this provision for free wheeling, it would be difficult to pull a sheet out of the pocket because there would be a tendency to force the feed rolls against the pocket wall, thus offering resistance against pull.

As seen in FIG. 1, the timers, associated relays R, and transformer T, are located in a readily accessible box 119 mounted on the upright leg of the frame.

Referring now in particular to FIGS. 5, 6 and 7 it will be seen that the apparatus includes a pivoted hood 125 through which the sheets are discharged. The hood extends from the left hand frame leg 25 to the right frame leg 25 and is provided with laterally extending partitions 126 and 127 dividing it into three sheet discharge channels 128, 129 and 130 terminating in sheet discharge openings 131, 132 and 133. Channel 128 is for the C-size sheets, channel 129 for the D-size sheets and channel 130 for the E-size sheets. In FIG. 6 the path of the discharging sheets is indicated by dash lines 134, 135 and 136.

The hood 125 is hinged at 137 to the frame end legs and is shown, in dot and dash lines at 125*a*, in its open, sheet loading, position (FIG. 6). As shown in FIG. 7, sponge-like edge seals 138 are provided between the hood and the frame legs 25 to seal against the entrance of light. Although some light could enter through the sheet discharge openings 131, 132 and 133, this is largely deflected or "bounced off" and the sheets are not subjected to direct light exposure.

From the above it will be clear that the hood not only acts as a light-restricting cover, but also as a guide for sheets for any one of the several magazines.

Associated with the hood 125 is a hinged access lid 139 having a sponge-like seal 140 between it and the hood to provide a light seal. This lid is adapted to be swung to the open position indicated in dot and dash lines at 139a in FIG. 6 to give access for sheet loading.

Another unique feature of the invention resides in the provision of means for preventing more than one sheet at a time being fed out of the pockets. This is prevented or minimized by the simple expedient of friction surfaces, for example of material sold under the trademark Scotch Tread and indicated by reference character 145, at the discharge outlets of the three pockets as best seen in FIG. 6. The Scotch Tread extends for the full width of the pockets (FIGS. 12, 13 and 14). Such Scotch Tread 146 is also provided at the inner surfaces of the top wall of the hood.

These friction surfaces or Scotch Tread act as follows. In the event that two sheets which are stuck together, for example, by reason of a burr caused in the cutting of the sheets, were fed upwardly, the leading edge of the rear sheet would engage the friction surface and be stopped to break the bond between the two sheets. It has been found in practice that when there is a full pack of sheets in the pocket there is no difficulty in feeding the sheets out one at a time. This is attributed in part to weight of the pack of sheets and to the slope or lean of the pockets. However, when feed of sheets approaches the end of a pack, there is a tendency for more than one sheet or even all of the remaining sheets to be fed out as a bundle, because in the absence of the friction surfaces referred to, the smooth surfaces of the pocket walls would not offer resistance to the sheet next to the wall and also because there would be greater friction between the remaining sheets, causing them to be discharged together.

Reverting now to the feed roll shafts, it will be observed that since they are spring loaded they would be urged to the left, as viewed in FIG. 6, and therefore when the pockets are empty of sheets they would in this position constitute an obstruction to the reloading of the pockets with sheets. In other words, they would have to be held to the right when reloading. To accomplish this in a simple manner the pockets 20 and 21 are provided with detent pins 150, 150 (FIG. 6) which when raised to their up positions, shown in full lines, allow the spring loaded roller shafts to swing freely to the left, and which, when pushed down to their dotted positions 150a, enter behind the shafts to hold them in retracted position leaving an unobstructed opening for ready sheet loading.

The feed roll shaft 92 of pocket 22 is held in such a retracted position by means of a latch shown in shaft release position at 151 in FIG. 6 and in shaft retracting position at 151a.

In order to prevent the rubber feed rolls from being squeezed against the adjacent pocket walls when the roll shafts are moved into retracted positions, Teflon buttons 152 (FIG. 6), engageable by the roll shafts, are provided in the adjacent pocket wall, which buttons act as stops limiting the movement of the roll shafts.

A very important feature of the present apparatus, in addition to its effectiveness of operation, resides in the compactness of its design, made possible by the employment of storage pockets for the sheets of various sizes which are closely nested together (FIG. 5) so as to keep the cross sectional dimension of the apparatus to a minimum. Also the novel manner of curving the pockets 21 and 22 for the sheets of larger size forwardly under the pocket 20 for the sheets of smaller size is advantageous in keeping the height of the apparatus down to a minimum. The sloping of the pockets is of importance not only from an operational standpoint but also in that a major portion of the apparatus projects under the feed board of the associated printer with the result that there is a minimum outward protrusion of the apparatus from the printer.

Its lightweight construction makes it easily portable and its caster adjustability enables it to be readily raised and lowered to match the cushioning pads 153 (FIGS. 1, 5 and 6) with the height of the printer feed board 31.

We claim:

1. In a paper sheet feeder of the type having a plurality of adjacent, generally upright and parallel sheet storage magazines, each dimensioned to store a stack of sheets of a different size, each magazine having a stack loading and sheet egress opening adjacent an upper edge portion thereof, and means for engaging the sheet stack in each magazine and for feeding the sheets, one at a time, from any selected magazine through the magazine opening and toward a zone of paper use, the improvements which comprise: a plurality of feed rolls each disposed within a corresponding one of said magazines for contact with an upper portion of a side sheet of the stack in that magazine, said feed rolls being rotatable to drive the contacted sheet outwardly of the magazine opening; a plurality of elongate lever means each disposed exteriorly of and having portions adjacent a corresponding one of said magazines; and each carrying one of said feed rolls, with freedom for swinging movement of the roll away from the stack in its corresponding magazine; means disposed in the region of the lower edges of said magazines and establishing a single axis extending in a direction transverse the planes of swinging movement of said lever means; means mounting lower end portions of each said lever means with freedom for pivotal movement about said single axis, and consequent swinging movement of each feed roll toward and away from its magazine stack; rigid frame means having spaced, vertically extending, end members supporting said magazines therebetween, said means for mounting said lever means being supported upon at least one of said end members; and such end member having, rigidly secured thereto, means contacting and confining intermediate portions of said lever means and preventing twisting movements of the latter.

* * * * *